US007128596B2

(12) United States Patent
Masaki et al.

(10) Patent No.: US 7,128,596 B2
(45) Date of Patent: Oct. 31, 2006

(54) PLUG-TYPE CONNECTOR AND ELECTRIC CONNECTOR COMPRISING THE SAME

(75) Inventors: Katsuyuki Masaki, Kanagawa (JP); Yusuke Hamada, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/860,136

(22) Filed: Jun. 4, 2004

(65) Prior Publication Data

US 2004/0248450 A1 Dec. 9, 2004

(30) Foreign Application Priority Data

Jun. 9, 2003 (JP) ..... 2003-164057

(51) Int. Cl.
*H01R 12/24* (2006.01)

(52) U.S. Cl. ..... 439/492

(58) Field of Classification Search ..... 439/492, 439/701, 579, 497, 607, 610, 494, 498, 857, 439/668, 637, 540.1, 660, 636
See application file for complete search history.

(56) References Cited

U.S. PATENT DOCUMENTS 6,273,753 B1 * 8/2001 Ko ..... 439/579
6,520,810 B1 * 2/2003 LePottier et al. ..... 439/701
6,860,755 B1 * 3/2005 Wang et al. ..... 439/498

FOREIGN PATENT DOCUMENTS

JP 11-329619 A 11/1999

* cited by examiner

*Primary Examiner*—J. F. Duverne
(74) *Attorney, Agent, or Firm*—Rader, Fishman & Grauer PLLC

(57) ABSTRACT

A plug-type connector for connecting end portions of a pair of FFCs extending in parallel to each other. The connecter is provided with: a holder having a placing frame provided on the surface and backside thereof with a pair of placing faces on which the end portions of the pair of FFCs are respectively placed; and a fixing member capable of fixing the end portions of the FFCs to the corresponding placing faces of the holder. The fixing member includes: an annular portion which defines an insertion hole into which the placing frame of the holder with the end portions of the FFCs placed on the corresponding placing faces, can be inserted together with the FFCs; and engagement portions which are engageable with corresponding engaged portions of the holder when the annular portion is brought toward the holder with the pair of FFCs previously inserted into the insertion hole of the annular portion.

8 Claims, 15 Drawing Sheets

PLUG-TYPE CONNECTOR AND ELECTRIC CONNECTOR COMPRISING THE SAME

BACKGROUND OF THE INVENTION

1. Field of the Invention

The present invention relates to a plug-type connector for connecting an FFC (Flexible Flat Cable), and an electric connector comprising such a plug-type connector.

2. Description of Related Art

Conventionally, an FPC (Flexible Printed Circuit) in the form of a flexible printed circuit board is connected to a base board by connecting a plug-type connector connected to an end of the FPC, to a receptacle-type base connector fixed to the base board.

For example, in a plug-type connector disclosed in Japanese Unexamined Patent Publication No. 11-329619 (1999), a plug housing is formed by a pair of mutually divided sandwiching members, which are connected to each other with an end of an FPC held by and between these sandwiching members. A fixing pin at one sandwiching member passes through a through-hole formed in the FPC at its widthwise intermediate position. This fixing pin is fitted to the other sandwiching member such that the FPC is securely held in the plug housing.

Generally, an FFC is smaller in the degree of freedom as to the conductor layout as compared with an FPC. Accordingly, it is difficult to form, in the FFC at its widthwise intermediate position, a through-hole or the like for a fixing pin as mentioned above. That is, the plug-type connector disclosed in the above-mentioned Publication can hardly be applied to FFC connection.

If the plug-type connector disclosed in the above-mentioned Publication is applied to FFC connection with no fixing pin used, this involves the likelihood that the FFC is unstably held due to variations of dimensional precision and combination precision of the sandwiching members, and the like.

On the other hand, there is desired a connector capable of collectively connecting a plurality of FFCs.

SUMMARY OF THE INVENTION

It is an object of the present invention to provide a plug-type connector which is capable of readily connecting and securely holding a plurality of FFCs, and also to provide an electric connector comprising such a plug-type connector.

The present invention provides a plug-type connector for connecting end portions of a pair of FFCs extending in parallel to each other. This plug-type connector comprises: a holder comprising a placing frame provided on the surface and backside thereof with a pair of placing faces on which end portions of a pair of FFCs are respectively placed; and a fixing member capable of fixing the end portions of the FFCs to the corresponding placing faces of the holder. The fixing member comprises: an annular portion which defines an insertion hole into which the placing frame of the holder with the end portions of the FFCs placed on the corresponding placing faces, can be inserted together with the FFCs; and engagement portions which are engageable with corresponding engaged portions of the holder when the annular portion is brought toward the holder with the FFCs previously inserted into the insertion hole of the annular portion.

According to the present invention having the arrangement above-mentioned, with the FFC end portions temporarily held by the corresponding placing faces of the placing frame of the holder, the FFC end portions and the placing frame are fitted into the annular portion of the fixing member such that the engagement portions of the fixing member engage with the engaged portions of the holder. Thus, the pair of FFCs can readily be connected to the plug-type connector. When an FFC is held by and between two sandwiching members connected to each other as conventionally done, this involves the likelihood that the FFC is unstably held due to variations of dimensional precision and combination precision of the sandwiching members. On the other hand, the present invention uses the fixing member having the annular portion, thus enabling the FFCs to be stably held.

The placing frame of the holder may comprise: first and second placing plates respectively provided on the mutually reverse sides thereof with placing faces; and connecting portions for connecting the first and second placing plates to each other. In this case, the fixing member preferably comprises: first and second frames for holding the ends of the corresponding FFCs in cooperation with the corresponding placing faces; and a pair of lateral frames for connecting the corresponding ends of the first and second frames to each other, the lateral frames and the first and second frames defining the annular portion. According to the arrangement above-mentioned, the pair of placing plates are connected to each other by the connecting portions to form the placing frame. This enables the holder to be improved in strength. Further, the fixing member is made in the form of a box structure using the first and second frames and the pair of lateral frames. This enables the fixing member to be improved in strength. Thus, the plug-type connector can be improved in strength in its entirety.

The first and second placing plates may be different from each other in width, and the first and second frames may also be different from each other in width. This arrangement prevents the placing frame of the holder from being inversely inserted into the annular portion of the fixing member.

Further, a concave may be formed between the rear end portions of the first and second placing plates of the holder, and the fixing member may comprise an intermediate frame which connects the pair of lateral frames to each other, which extends in parallel to the first and second frames, and which is engageable with the concave. According to the arrangement above-mentioned, the intermediate frame of the fixing member is fitted into the concave between the placing plates of the holder, and the first and second placing plates are fitted into the annular portion at both sides of the intermediate frame. This enables the holder and the fixing member to be joined to each other without any backlash or looseness.

A reinforcing sheet may be attached to the backside of the end portion of each of the FFCs for holding exposed conductors in a row. In this case, a pulling-out preventing projection is preferably formed on each of the placing faces of the holder, this pulling-out preventing projection being engageable with an edge portion of the reinforcing sheet of each of the FFCs. According to the arrangement above-mentioned, before the fixing member is mounted, the FFCs can be temporarily held with their end portions placed on the placing faces of the holder. This improves the working efficiency of connecting the FFCs to the plug-type connector. Further, such improvement can be achieved by a simple structure utilizing the reinforcing sheets of the FFCs. Further, provision is made such that the FFCs are prevented from being pulled out after assembled. The pulling-out preventing projections fulfill their function as far as they can engage with the thin reinforcing sheets. Accordingly, the projecting amount may be small. Thus, the plug-type connector can be made low in height.

The holder may comprise, on each of the placing faces, a pair of holding frames for defining grooves into which a pair of lateral edges of each of the end portions of the corresponding FFCs, are introduced. In this case, the plug-type connector of the present invention is preferably arranged such that the fixing member comprises a pair of projection portions which project from each of the first and second frames to come in contact with the corresponding holding frames of the holder, that the engagement portions are formed on the projection portions, and that the corresponding holding frames and the projection portions are combined with each other, thus forming a part of an insertion projecting portion to be inserted into an insertion concave of a counter-connector.

According to the arrangement above-mentioned, the holding frames of the holder and the projection portions of the fixing member, form a part of the insertion projecting portion, which is inserted into the insertion concave of a counter-connector. This assures a secure connector connection. Further, the holding frames and the projection portions not only serve as the insertion projecting portion, but are also utilized for defining the grooves and forming the engagement portions. Thus, the holding frames and the projection portions can fulfill a plurality of functions even though they have a simple structure.

An electric connector of the present invention comprises: a plug-type connector having the features above-mentioned; and a receptacle-type connector combined with the plug-type connector. The receptacle-type connector comprises: a housing defining an insertion concave into which the insertion projecting portion of the plug-type connector is inserted; and a plurality of contacts arranged side by side in the insertion concave. The present invention can provide an electric connector ideal for connection of a pair of FFCs to a board when used with the receptacle-type connector attached to the board.

These and other features, objects and advantages of the present invention will be more fully apparent from the following detailed description set forth below when taken in conjunction with the accompanying drawings.

DESCRIPTION OF THE PREFFERED EMBODIMENTS

Figure 1:
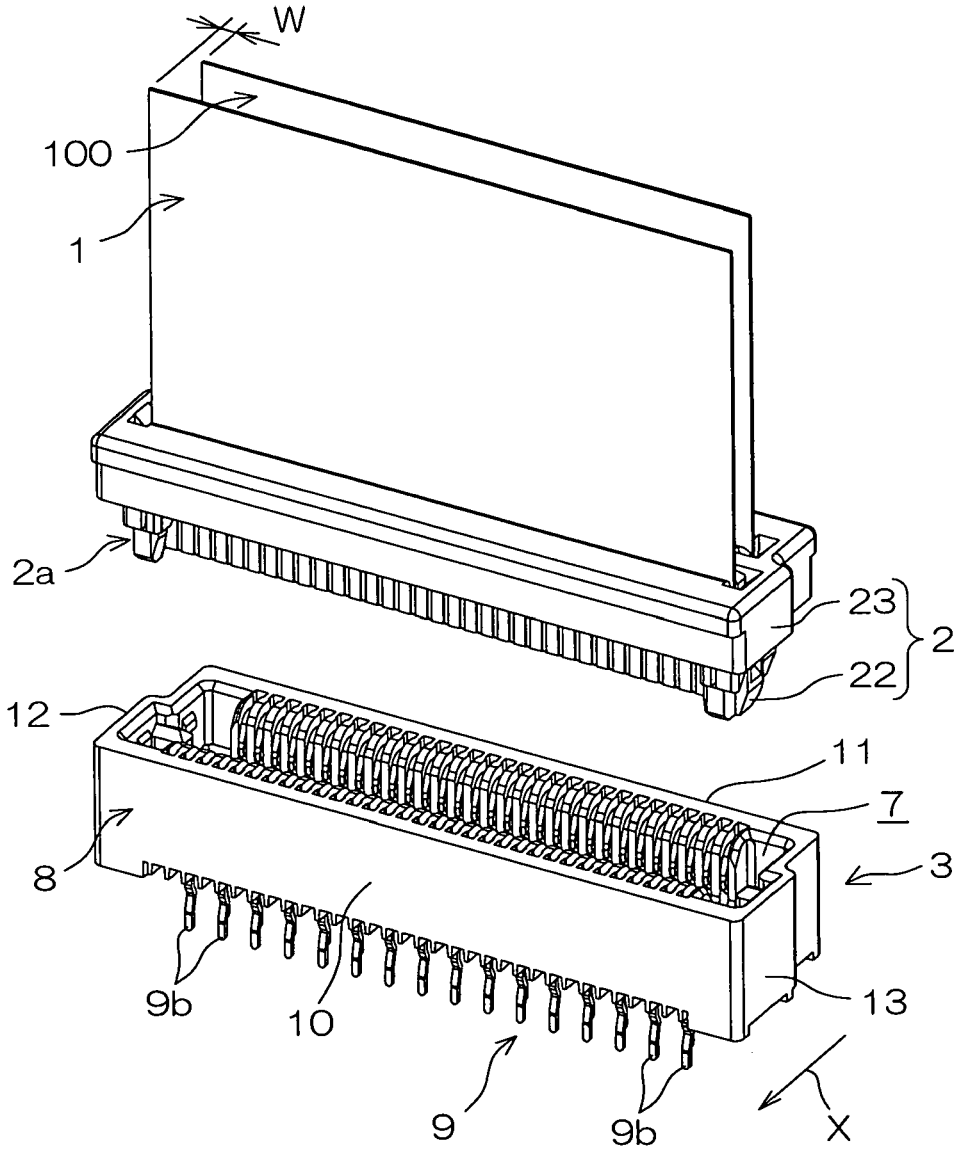
FIG. 1 is an exploded perspective view of a base connector and a plug-type connector according to an embodiment of the present invention.
Figure 2:
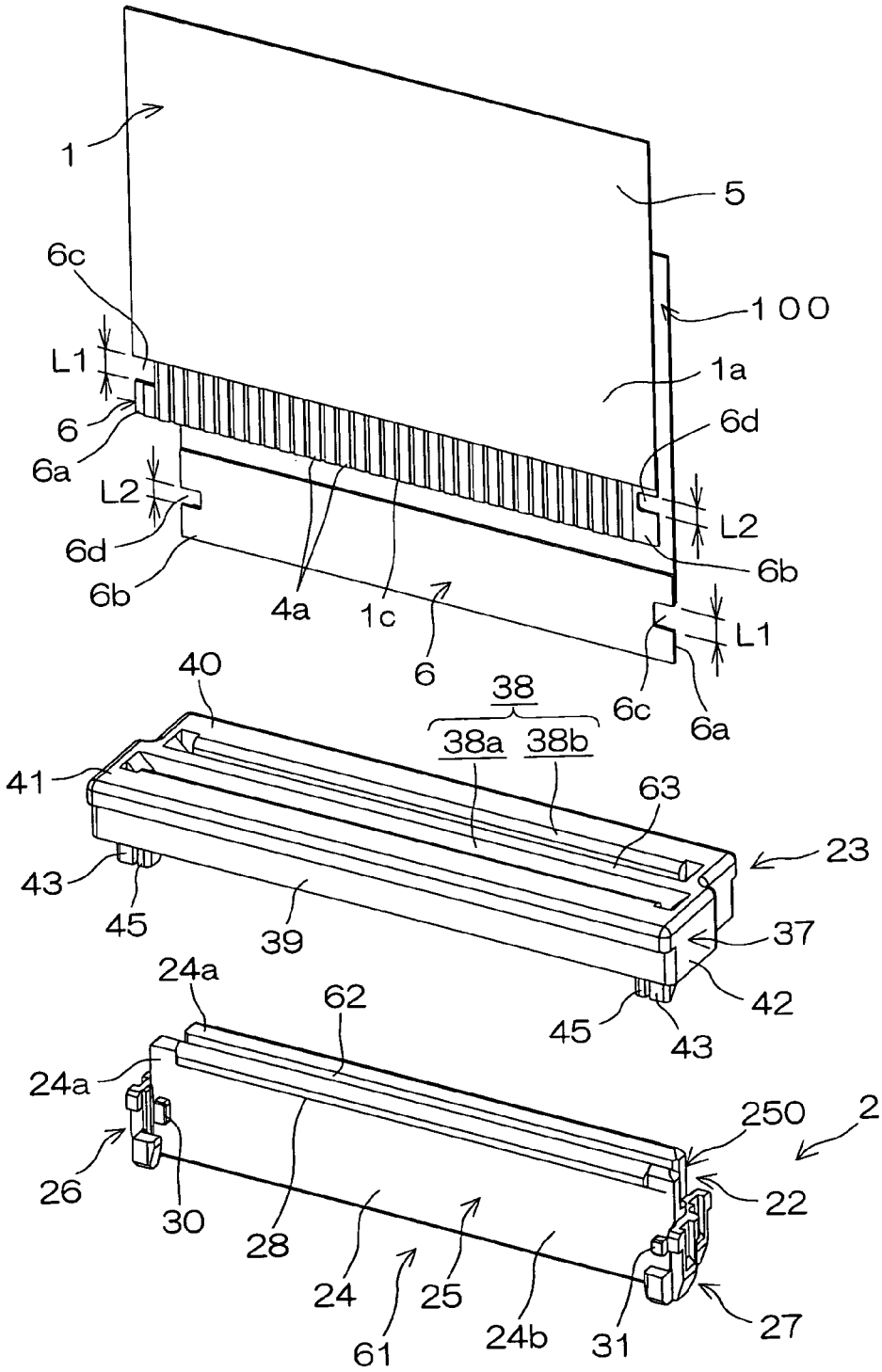
FIG. 2 is an exploded perspective view of the plug-type connector and FFCs.

FIG. 1 is an exploded perspective view of (i) a plug-type connector 2, according to an embodiment of the present invention, to which a pair of FFCs 1, 100 are connected, and (ii) a base connector 3 serving as a receptacle-type connector. FIG. 2 is an exploded perspective view of the FFCs 1, 100 and the plug-type connector 2, and FIG. 3 is a section view of the FFC 1.

Figure 3:
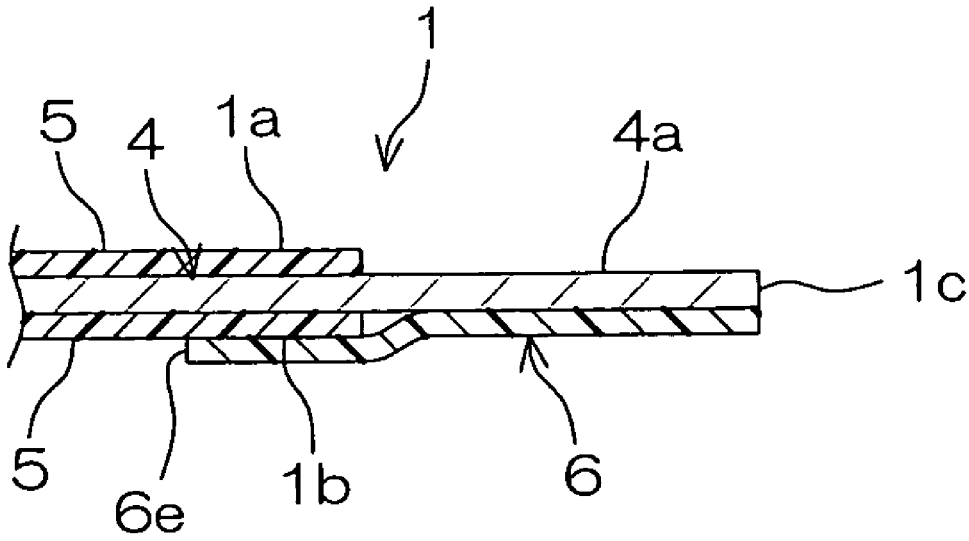
FIG. 3 is a schematic section view of the FFC.

Referring to FIGS. 2 and 3, the FFC 1 comprises a number of conductors 4 arranged side by side, and insulating films 5 laminated on the both sides of the conductors 4. A synthetic resin reinforcing sheet 6 is attached to the backside 1*b* of an end portion 1*a* of the FFC 1. The reinforcing sheet 6 aligns and holds exposed conductors 4*a* extending from the end portion 1*a* of the FFC 1. Referring to FIG. 2, the reinforcing sheet 6 is provided in a pair of lateral edges 6*a*, 6*b* thereof with first and second concaved grooves 6*c*, 6*d*. Each of the concaved grooves 6*c*, 6*d* is substantially rectangular for example. Provision is made such that the widths L1, L2 of the first and second concaved grooves 6*c*, 6*d* are different from each other with respect to the longitudinal direction of the FFC 1.

The FFC 100 has an arrangement similar to that of the FFC 1. The FFCs 1, 100 are disposed with their backsides being opposite to each other. The FFC 100 has a width smaller by a predetermined distance W than the width of the FFC 1. More specifically, the number of the conductors 4 of the FFC 100 is smaller than that of the conductors 4 of the FFC 1.

Figure 5:
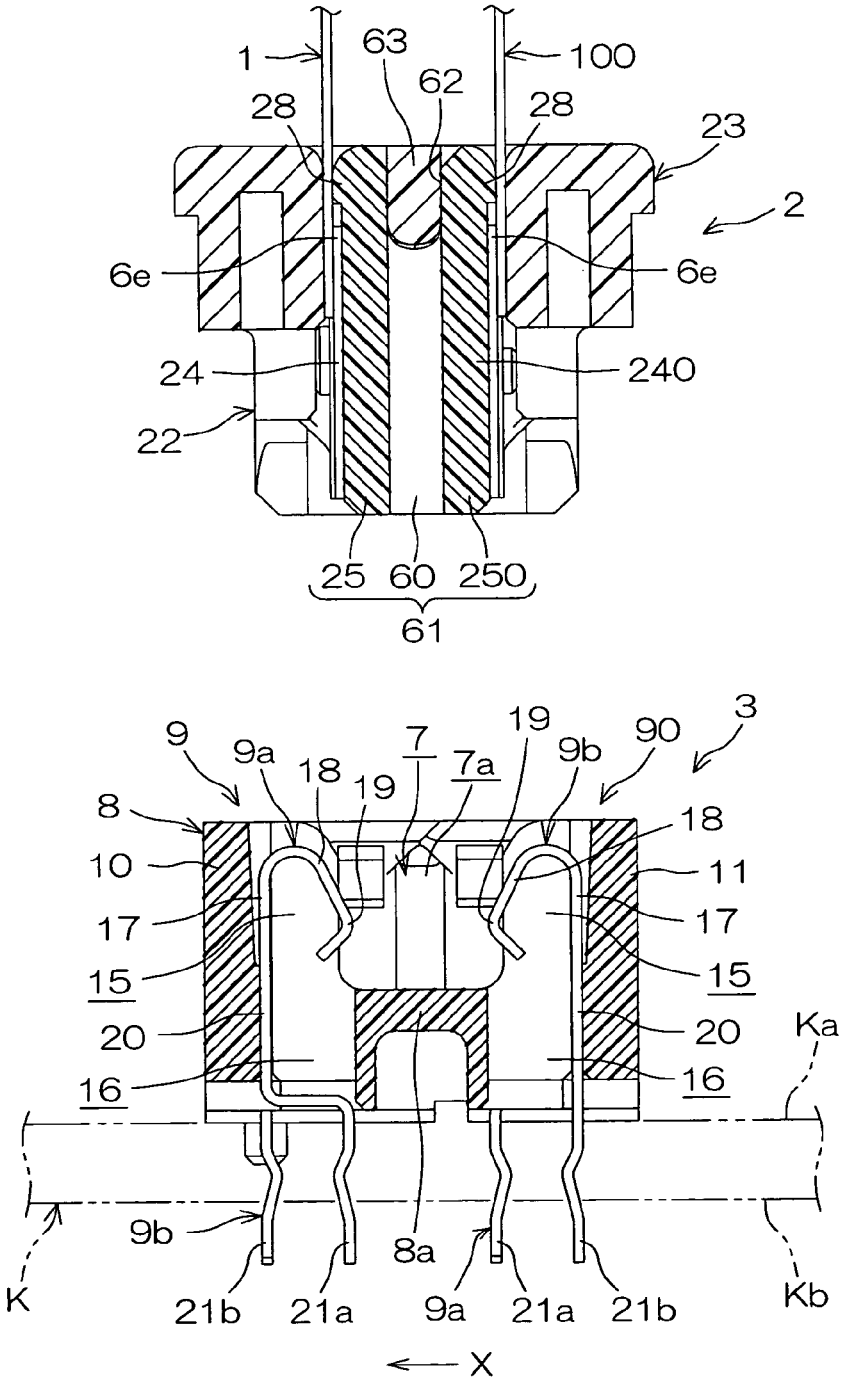
FIG. 5 is an exploded section view of the plug-type connector and the base connector.

Referring to FIGS. 1 and 5, the base connector 3 comprises: a base housing 8 which defines an insertion concave 7, which is made of an insulating synthetic resin, and which is to be attached to the surface Ka of a board K; and two contact rows 9, 90 each having contacts 9*a*, 9*b* which pass through the base housing 8 and which are alternately disposed side by side.

Figure 4:
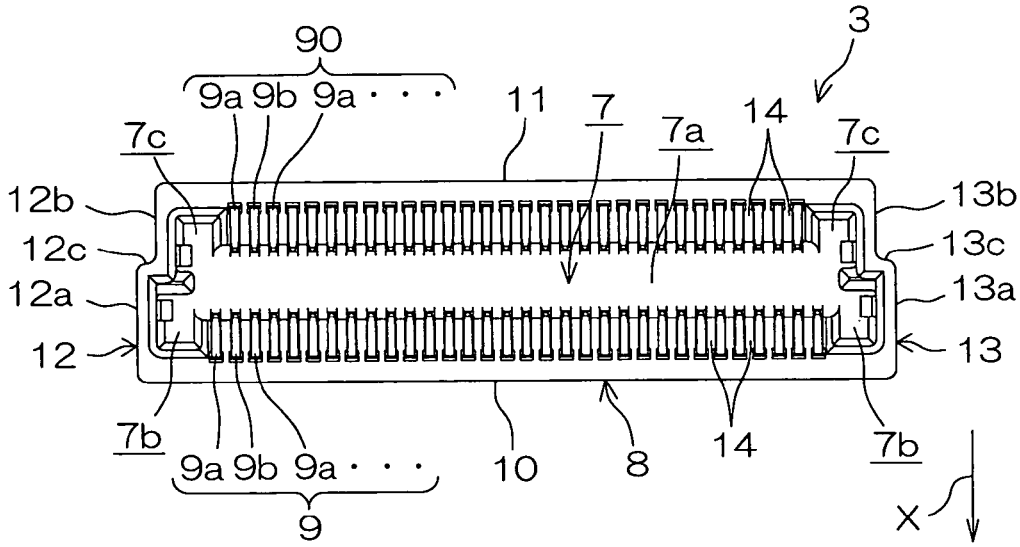
FIG. 4 is a schematic plan view of the base connector.

Referring to FIGS. 1 and 4, the base housing 8 has first and second walls 10, 11 opposite to each other, and a pair of lateral walls 12, 13 which connect the opposite ends of the first and second walls 10, 11 to each other. These walls 10 to 13 define the insertion concave 7. For convenience's sake, the side of the base connector 3 at which the first wall 10 is disposed, is referred to as the front side X.

The lateral walls 12, 13 have first portions 12*a*, 13*a* between which the distance is relatively wide, and second portions 12*b*, 13*b* between which the distance is relatively narrow. The lateral walls 12, 13 further have step portions 12*c*, 13*c* between the first portions 12*a*, 13*a* and the second portions 12*b*, 13*b*.

Referring to FIG. 4, the insertion concave 7 has a first concave 7*a* along the second wall 11, and a pair of second concaves 7*b* and a pair of third concaves 7*c* which communicate with both ends of the first concave 7*a*. The pair of second concaves 7*b* are formed at both sides of the contact row 9 and extend along the first portions 12*a*, 13*a* of the lateral walls 12, 13. The pair of third concaves 7*c* are formed at both sides of the contact row 90 and extend along the second portions 12*b*, 13*b* of the lateral walls 12, 13.

Referring to FIGS. 4 and 5, a plurality of partition walls 14 in the form of a rib of comb teeth are disposed side by side at each of the first and second walls 10, 11 defining the insertion concave 7. The partition walls 14 extend into the first concave 7*a* of the insertion concave 7. Contact holding grooves 15 which hold corresponding contacts 9*a*, 9*b* of the corresponding contact rows 9, 90, are formed between adjacent partition walls 14. The contact holding grooves 15 are opened in the first concave 7*a* of the insertion concave 7. The contacts 9*a*, 9*b* of the contact row 9 are so disposed as to be opposite to the contacts 9*a*, 9*b* of the contact row 90 in the back and forth direction of the base housing 8.

Referring to FIG. 5, contact holding holes 16 which hold corresponding contacts 9*a*, 9*b* of the corresponding contact rows 9, 90, are formed in the bottom 8*a* of the base housing 8 at the lower part of the insertion concave 7. The contact holding holes 16 communicate with the corresponding contact holding grooves 15.

Each contact 9*a* has a long main body 17 housed in a contact holding groove 15, and a projecting portion 18 turned down from the tip of the main body 17 and curved in the form of a mountain. The top of the projecting portion 18 forms a contact portion 19 entering inside of the first concave 7*a* of the insertion concave 7. Further, each contact 9*a* comprises: a press-fitting portion 20 which extends from the main body 17 and which is pressed in a contact holding hole 16; and a lead 21*a* which extends from the press-fitting portion 20 and which downwardly projects from the base housing 8.

The alternately disposed contacts 9*a*, 9*b* have leads 21*a*, 21*b* different from each other only in shape. Each lead 21*a* is made in the form of a hook, while each lead 21*b* extends substantially straight from the press-fitting portion 20. Accordingly, the leads 21*a*, 21*b* are disposed in a zigzag manner with their positions alternately shifted back and forth. The leads 21*a*, 21*b* pass through the board K and are soldered on the backside Kb thereof.

Referring to FIGS. 1 and 2, the plug-type connector 2 has a holder 22 for holding the end portions 1*a* of a pair of FFCs 1, 100 and a fixing member 23 for fixing the pair of FFCs 1, 100 to the holder 22.

Figure 6A:
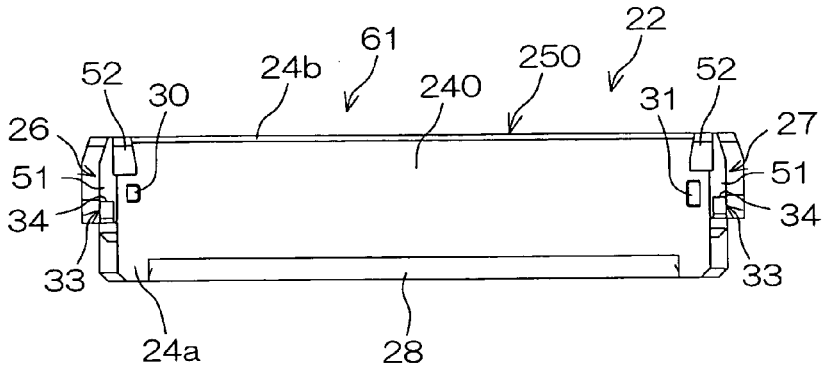
FIG. 6(*a*), FIG. 6(*b*) and FIG. 6(*c*) are respectively plan, front and back views of a holder.
Figure 6B:
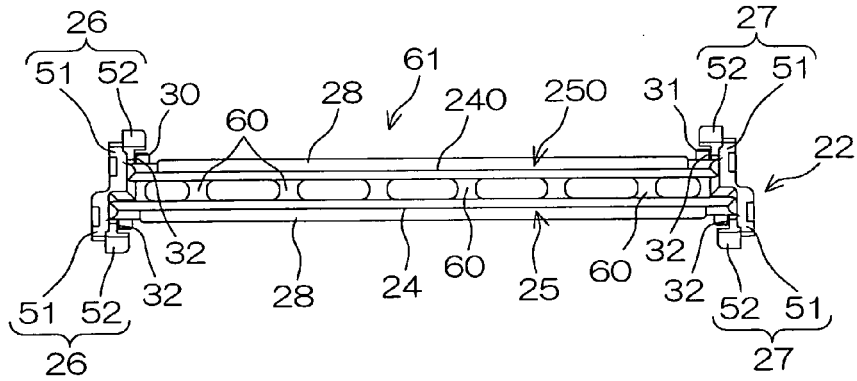
Figure 6C:
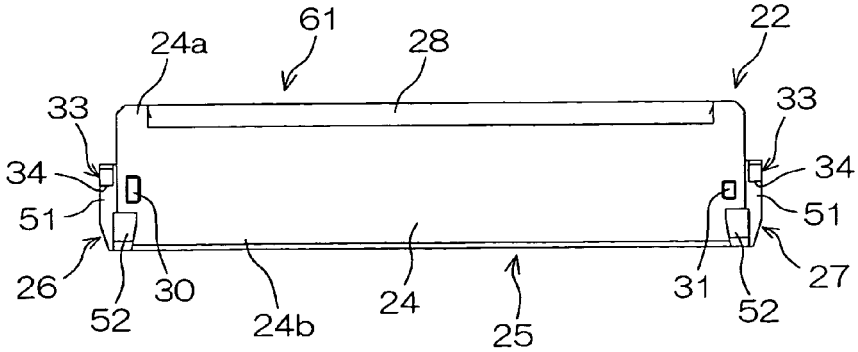
Figure 7:
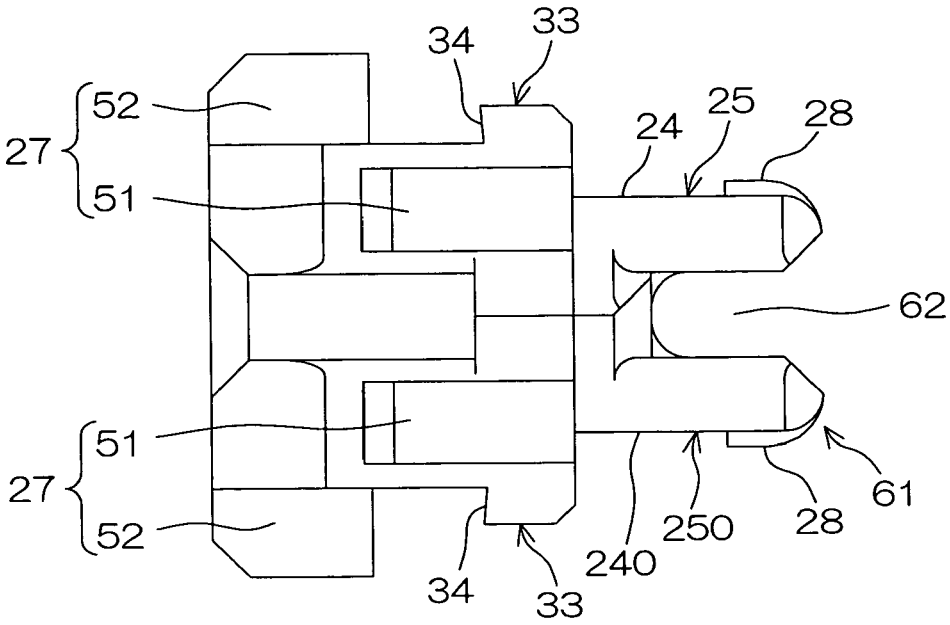
FIG. 7 is a side view of the holder.

Referring to FIGS. 2, 6(*a*), 6 (*b*), 6(*c*), 7 and 12, the holder 22 comprises: a placing frame 61 formed by connecting mutually parallel first and second placing plates 25, 250 by connecting portions 60; a pair of placing faces 24, 240 formed on the placing plates 25, 250 at their mutually reverse sides; and a pair of holding frames 26, 27 respectively disposed on each of the placing faces 24, 240 at their front sides. As shown in FIG. 7, a concave 62 is formed between the rear end portions of the first and second placing plates 25, 250.

Referring to FIGS. 2, 6(*a*) and 6(*c*), pulling-out preventing projections 28 are respectively formed on the placing faces 24, 240 at the rear edge portions 24*a* thereof. As shown in FIGS. 3 and 5, the pulling-out preventing projections 28 are respectively engaged with rear edge portions 6*e* of the reinforcing sheets 6 of the FFCs 1, 100 placed on the placing faces 24, 240, thus preventing the FFCs 1, 100 from being pulled out.

As each pulling-out preventing projection 28, a single long pulling-out preventing projection may be disposed on each of the placing faces 24, 240 as shown in FIGS. 6(*a*) and 6(*c*), or a plurality of pulling-out preventing projections may be disposed at regular intervals. Each pulling-out preventing projection 28 fulfills its function as far as it can engage with the reinforcing sheet 6. Accordingly, the projecting amount may be very small (for example, about 0.2 mm).

Each of the placing faces 24, 240 is provided at both lateral sides thereof with positioning projections 30, 31 engageable with the concaved grooves 6*c*, 6*d* (See FIG. 2) of each of the FFCs 1, 100. The positioning projections 30, 31 have such proper widths as to be just fitted into the concaved grooves 6*c*, 6*d*, respectively. This prevents the wrong sides of the FFCs 1, 100 from being respectively placed on the placing faces 24, 240.

Referring to FIGS. 6(*a*), 6(*b*), 6(*c*) and 12, the pair of holding frames 26, 27 disposed on each of the placing faces 24, 240, have lateral frames 51 standing from the lateral edges of each of the placing plates 25, 250, and upper frames 52 inwardly extending from the upper front portions of the lateral frames 51. As shown in FIG. 6(*b*), the upper frames 52, the lateral frames 51 and the corresponding placing plates 25, 250, define grooves 32 into which the corresponding lateral edges of the end portions 1*a* of the FFCs 1, 100 can be introduced.

Referring to FIGS. 6(*a*), 6(*b*), 6(*c*) and 7, projections 33 are formed at the upper rear portions of the lateral frames 51. The projections 33 comprise engaged portions 34 with which hooks serving as engagement portions of the fixing member 23 to be discussed later, are engaged.

Figure 8:
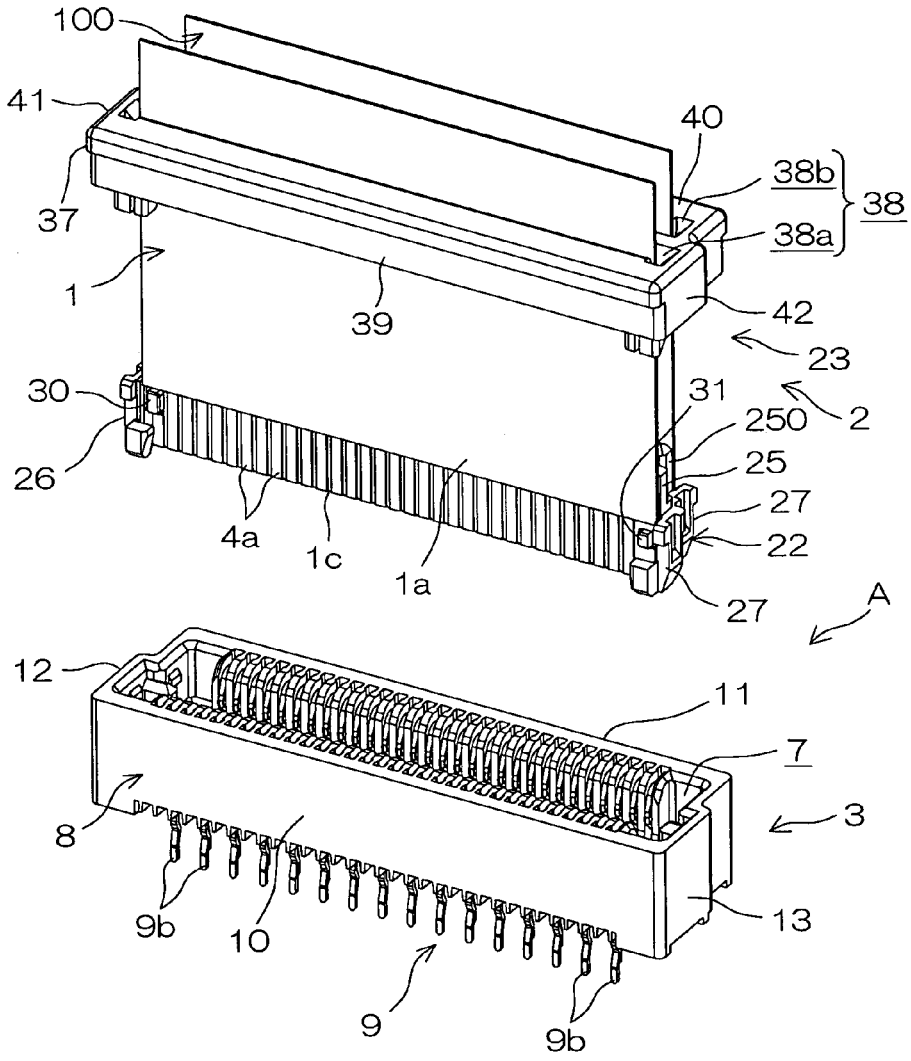
FIG. 8 is an exploded perspective view of the base connector and the plug-type connector in the course of assembling.
Figure 9A:
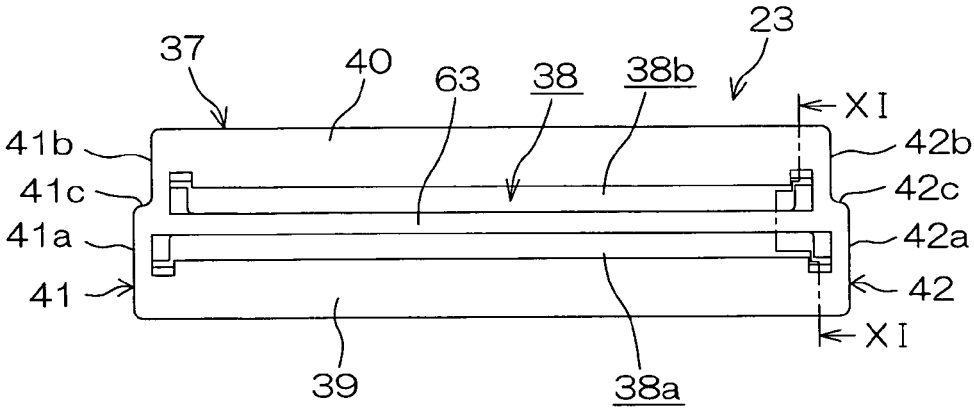
FIG. 9(*a*) is a plan view of a fixing member, and FIG. 9(*b*) is a front view of the fixing member.
Figure 9B:
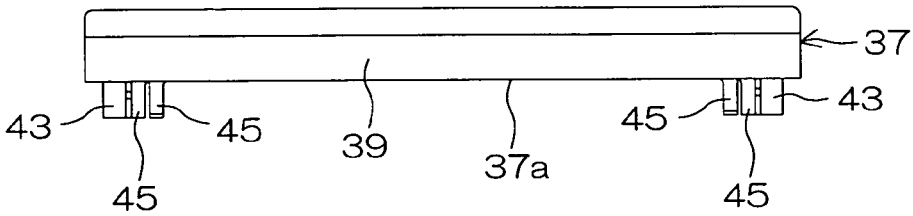

Referring to FIGS. 2, 9(*a*), 9(*b*), 10, 11 and 12, the fixing member 23 has an annular portion 37. As shown in FIG. 8, this annular portion 37 defines a substantially rectangular insertion hole 38 into which the placing frame 61 of the holder 22 with the end portions 1*a* of the FFCs 1, 100 placed thereon, is inserted together with the FFCs 1, 100.

Referring to FIGS. 9(*a*) and 9(*b*), the annular portion 37 comprises: first and second frames 39, 40 respectively corresponding to the placing faces 24, 240 of the first and second placing plates 25, 250 of the holder 22; and a pair of lateral frames 41, 42 for connecting the opposite ends of the first and second frames 39, 40 to each other. These frames 39 to 42 define the insertion hole 38. The lateral frames 41, 42 have first portions 41*a*, 42*a* between which the distance is relatively wide, and second portions 41*b*, 42*b* between which the distance is relatively narrow. The lateral frames 41, 42 further comprise step portions 41*c*, 42*c* between the first portions 41*a*, 42*a* and the second portions 41*b*, 42*b*.

The fixing member 23 has an intermediate frame 63 which is connected to the lateral frames 41, 42 and which extends in parallel to the first and second frames 39, 40. The intermediate frame 63 divides the insertion hole 38 into first and second insertion holes 38*a*, 38*b* into which the first and second placing plates 25, 250 are respectively inserted.

Figure 10:
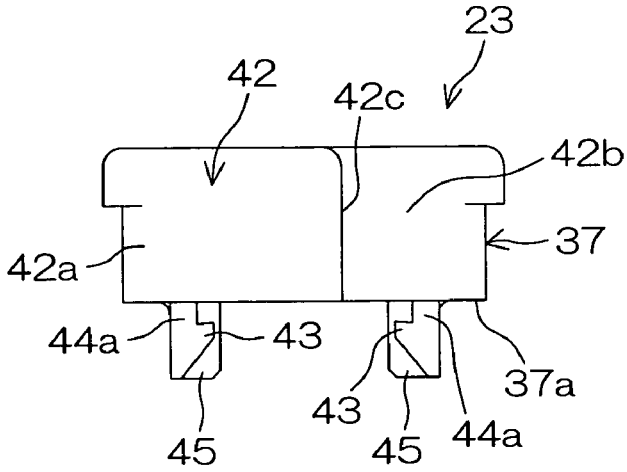
FIG. 10 is a side view of the fixing member.
Figure 11:
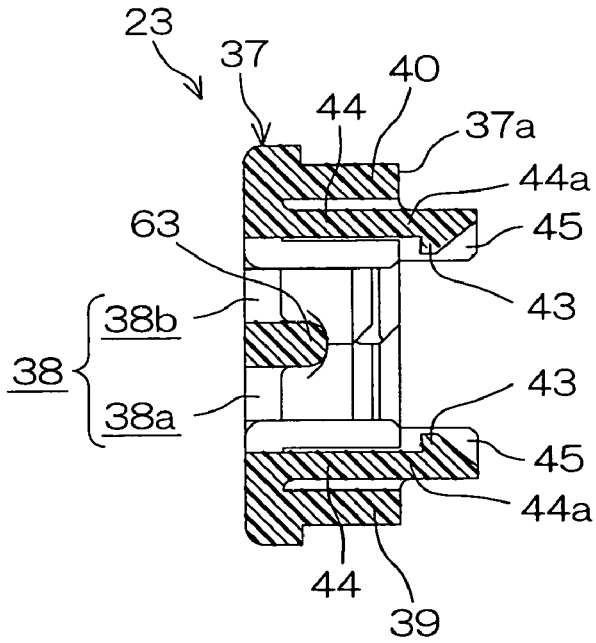
FIG. 11 is a section view taken along the line XI—XI in FIG. 9(*a*)

Two pairs of engagement portions 43 comprise hooks engageable with the engaged portions 34 of two pairs of projections 33 of the holder 22, and project from a connection-side end face 37*a* of the annular portion 37. As shown in FIGS. 10 and 11 which is a section view taken along the line XI—XI in FIG. 9(*a*), cantilevered resilient pieces 44 are formed inside of the first and second walls 39, 40, and the engagement portions 43 comprising hooks are formed at the ends of those projection portions 44*a* of the resilient pieces 44 which project from the annular portion 37.

Referring to FIGS. 9(*a*), 9(*b*) and 10—16, in the vicinity of the inner sides of each pair of engagement portions 43, a pair of positioning projections 45 project from the connection-side end face 37*a* of the annular portion 37.

Figure 12:
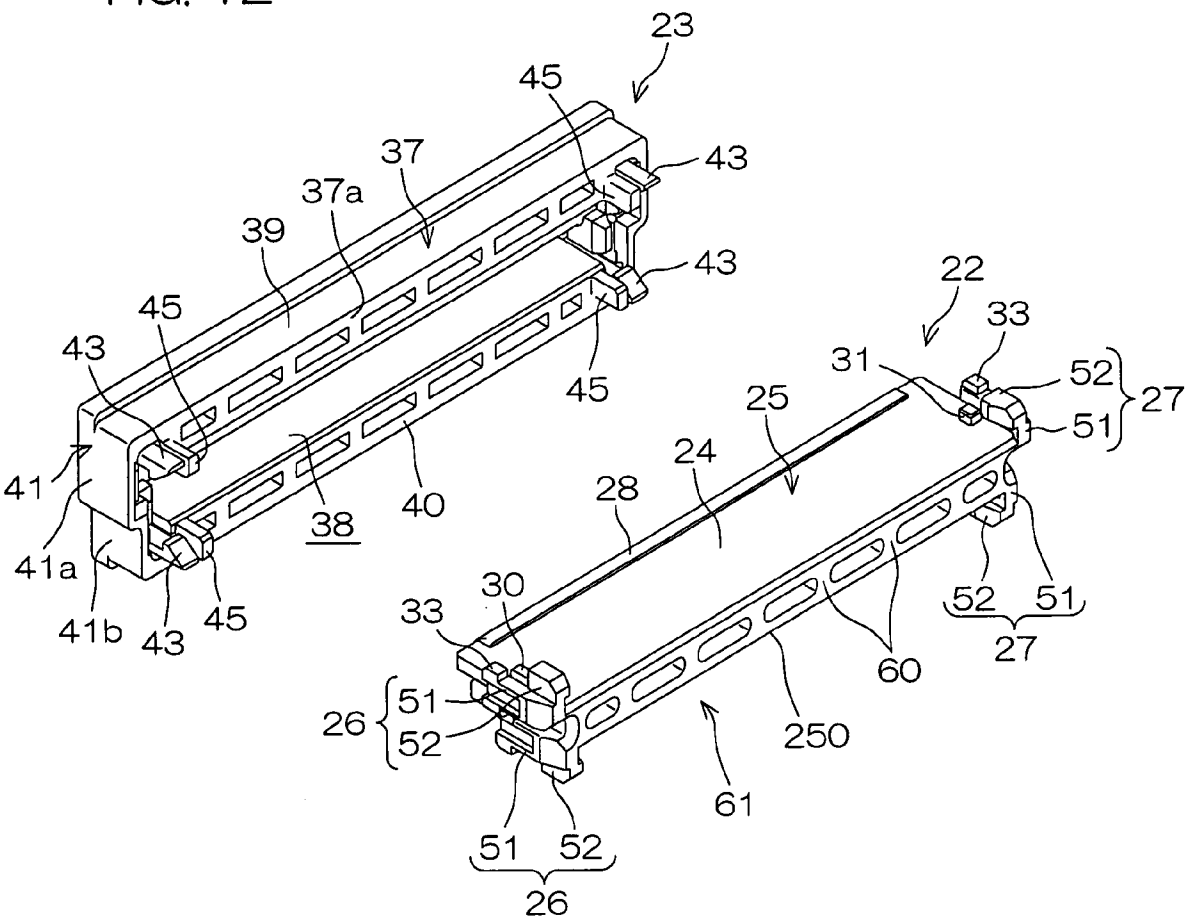
FIG. 12 is an exploded perspective view of the holder and the fixing member.
Figure 13:
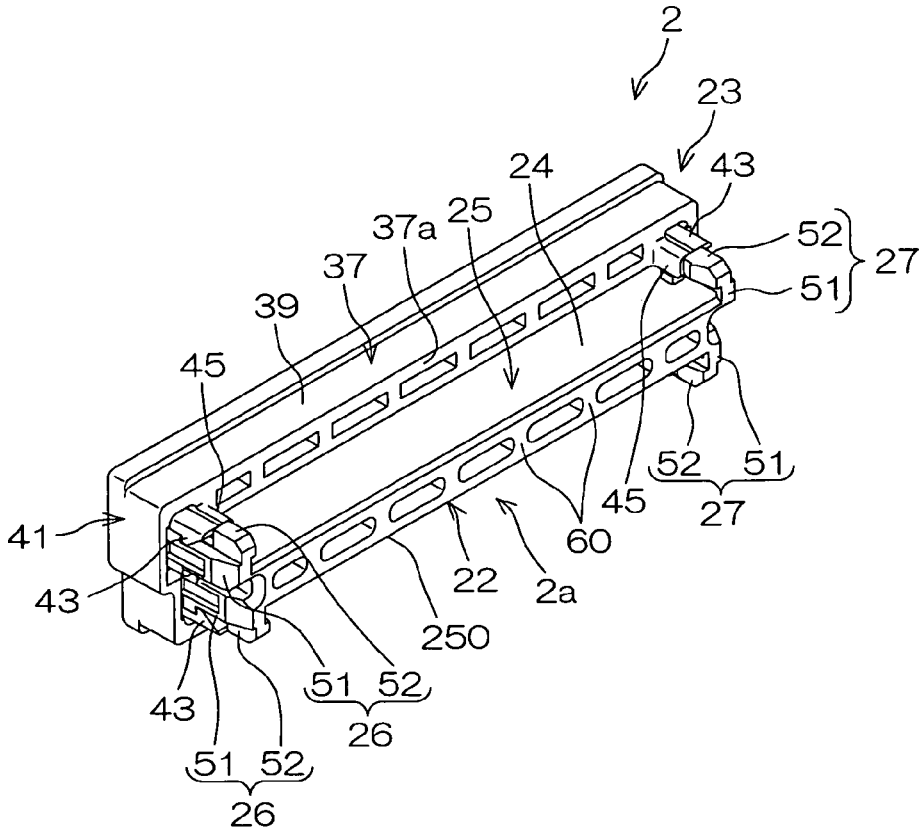
FIG. 13 is a schematic perspective view of the plug-type connector in which the holder and the fixing member are being assembled with each other.
Figure 14:
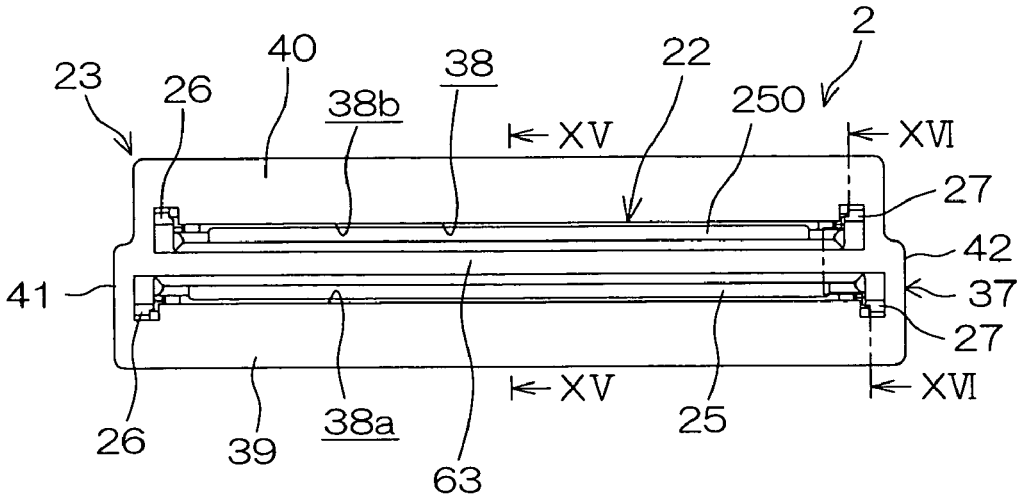
FIG. 14 is a plan view of the plug-type connector in which the holder and the fixing member are being assembled with each other.

Referring to FIGS. 12 and 13, the rear part of the holder 22 is inserted into the insertion hole 38 of the annular portion 37 of the fixing member 23, and the engagement portions 43 of the fixing member 23 get over the projections 33 of the holder 22 and then engage with the engaged portions 34. Thus, the fixing member 23 and the holder 22 are joined to each other to form a plug-type connector 2.

As shown in FIG. 2, when the holder 22 and the fixing member 23 properly face each other, the first and second placing plates 25, 250 of the holder 22 can respectively be inserted into the first and second insertion holes 38*a*, 38*b* of the fixing member 23. Accordingly, the holder 22 and the fixing member 23 can be joined to each other. On the other hand, when the holder 22 and the fixing member 23 do not properly face each other, the first placing plate 25 cannot be inserted into the narrower second insertion hole 38*b*, thus preventing the holder 22 and the fixing member 23 from being joined to each other.

As shown in FIG. 13, the tips of both the engagement portions 43 and the positioning projections 45 of the fixing member 23, come in contact with the corresponding upper frames 52 of the holder 22 to properly position the fixing member 23 and the holder 22.

In the assembly state of the plug-type connector 2 shown in FIG. 13, that portion of the fixing member 23 which projects forwardly from the connection-side end face 37*a* of the annular portion 37, forms an insertion projecting portion 2*a* of the plug-type connector 2. More specifically, the insertion projecting portion 2*a* includes the front parts of the placing plates 25, 250 of the holder 22, the first and second holding frames 26, 27 of the holder 22, and the engagement portions 43 and the positioning projections 45 of the fixing member 23.

Figure 17:
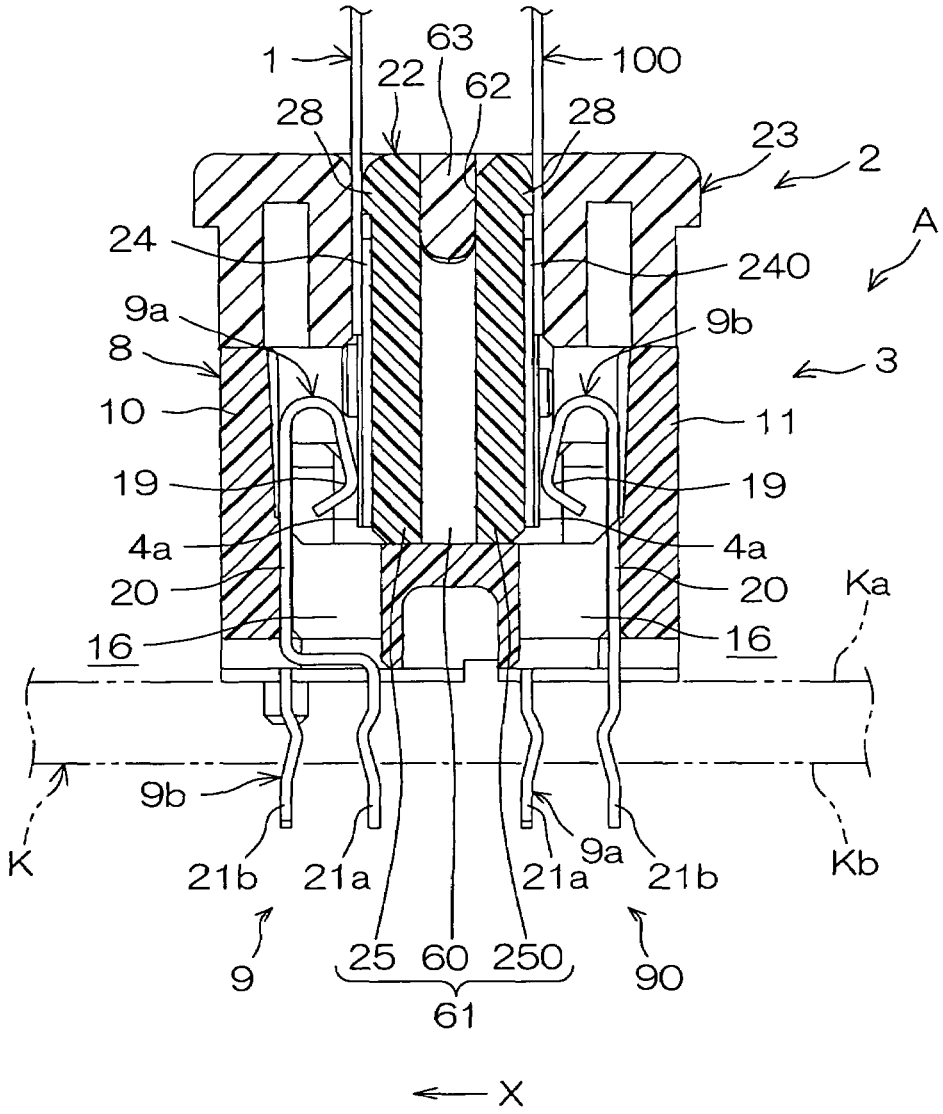
FIG. 17 is a section view of the base connector and the plug-type connector connected to each other.

This insertion projecting portion 2*a* is to be inserted into the insertion concave 7 of the base connector 3 shown in FIGS. 4 and 5. More specifically, out of the insertion projecting portion 2*a*, the front parts of the placing plates 25, 250 of the holder 22 are inserted into the first concave 7*a* (See FIG. 4) of the insertion concave 7, and (i) the first and second holding frames 26, 27 of the holder 22 and (ii) the engagement portions 43 and the positioning projections 45 of the fixing member 23, are inserted into the corresponding second concaves 7*b* and third concaves 7*c* (See FIG. 4) of the insertion concave 7. Thus, as shown in FIG. 17, an electric connector A is assembled. In the electric connector A, exposed conductors 4*a* of the FFCs 1, 100 connected to the plug-type connector 2, are pressed to and contacted with the contact portions 19 of the corresponding contacts 9*a*, 9*b* of the base connector 3, thereby to achieve electric connection.

Figure 16:
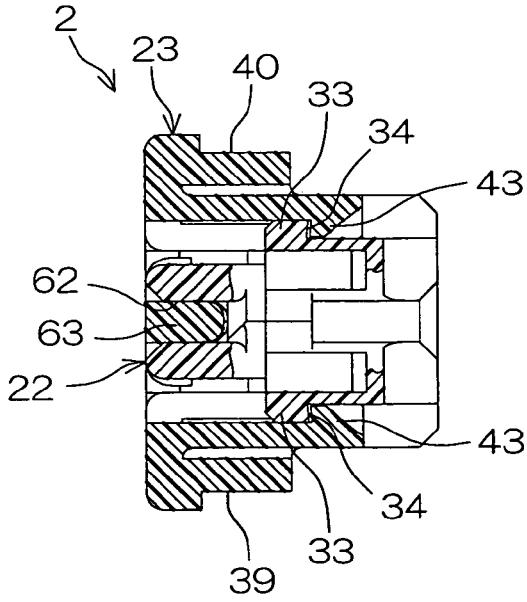
FIG. 16 a section view taken along the line XVI—XVI in FIG. 14.

As to the connection of the FFCs 1, 100 to the plug-type connector 2, the FFCs 1, 100 are previously inserted into the corresponding insertion holes 38*a*, 38*b* of the annular portion 37 of the fixing member 23 such that the end portions 1*a* of the FFCs 1, 100 are temporarily held by the corresponding placing plates 25, 250 of the holder 22 as shown in FIG. 8. At this state, the end portions 1*a* of the FFCs 1, 100 and the placing plates 25, 250 are fitted into the annular portion 37 of the fixing member 23, and the engagement portions 43 of the fixing member 23 engage with the engaged portions 34 of the projections 33 of the holder 22 as shown in FIG. 16. In this manner, the plug-type connector 2 can readily be connected to the FFCs 1, 100 as shown in FIG. 1.

When an FFC is held by and between two sandwiching members connected to each other as conventionally done, this involves the likelihood that the FFC is unstably held due to variations of dimensional precision and combination precision of the sandwiching members. On the other hand, the present invention uses the fixing member 23 having the annular portion 37, thus enabling the FFCs 1, 100 to be stably held.

Further, the pair of placing plates 25, 250 are connected to each other by the connecting portions 60 to form the placing frame 61. This enables the holder 22 to be improved in strength. Further, the fixing member 23 is made in the form of a box structure using the first and second frames 39, 40 and the pair of lateral frames 41, 42. This improves the fixing member 23 in strength. Thus, the plug-type connector 2 can be improved in strength in its entirety.

Figure 15:
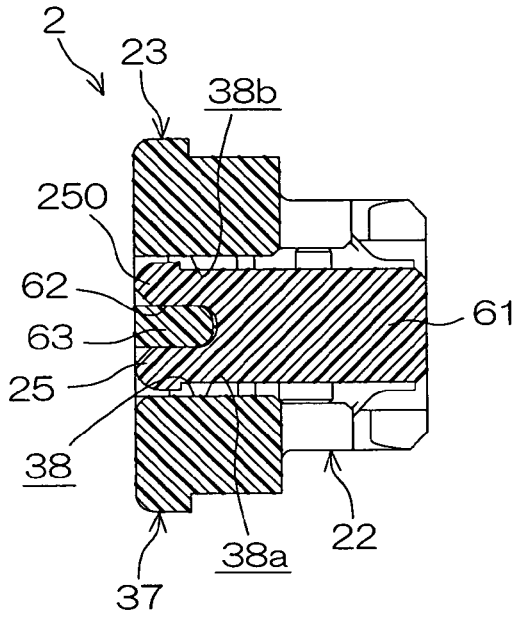
FIG. 15 is a section view taken along the line XV—XV in FIG. 14.

In particular, the pair of lateral frames 41, 42 are connected to each other by the intermediate frame 63 to further improve the fixing member 23 in strength. In addition, as shown in FIG. 15, when the holder 22 and the fixing member 23 are joined to each other, the intermediate frame 63 of the fixing member 23 is fitted into the concave 62 between the placing plates 25, 250 of the holder 22, and the placing plates 25, 250 are respectively fitted into the insertion holes 38*a*, 38*b* at both sides of the intermediate frame 63. This enables the holder 22 and the fixing member 23 to be firmly joined to each other without any backlash or looseness.

Further, the placing plates 25, 250 of the holder 22 are different from each other in width, and the insertion holes 38*a*, 38*b* are also different from each other in width. This prevents the holder 22 from being inversely inserted into the annular portion 37 of the fixing member 23. Further, it is not required to pay special attention to prevention of inverse assembling, thus improving the working efficiency.

Further, as shown in FIG. 8, before the fixing member 23 is mounted, the end portions 1*a* of the FFCs 1, 100 can be temporarily held as placed on the corresponding placing plates 25, 250 of the holder 22. This improves the working efficiency of connecting the FFCs 1, 100 to the plug-type connector 2. Further, such improvement can be achieved by a simple structure utilizing the reinforcing sheets 6 of the FFCs 1, 100. Further, provision is made such that the FFCs 1, 100 are prevented from being pulled out after assembled. The pulling-out preventing projections 28 fulfill their function as far as they can engage with the thin reinforcing sheets 6. Accordingly, the projecting amount may be small. Thus, the plug-type connector 2 can be made low in height.

Further, the positioning projections 30, 31 on the placing faces 24, 240 of the placing plates 25, 250 of the holder 22, are engaged with the concaved grooves 6*c*, 6*d* in the FFCs 1, 100. This improves the precision of positioning the FFCs 1, 100 with respect to the placing plates 25, 250. This also contributes to prevention of the FFCs 1, 100 from being pulled out. Further, the concaved grooves 6*c*, 6*d* have different widths L1, L2, respectively, thus preventing the FFCs 1, 100 from being inversely placed on the placing plates 25, 250.

The present invention should not be limited to the embodiments above-mentioned. For example, one or more positioning projections (not shown) for positioning the front ends of the FFCs 1, 100, may be disposed along the front edge portions 24*b* (See FIGS. 6(*a*) and 6(*c*)) of the placing faces 24, 240.

Further, the first and second concaved grooves 6*c*, 6*d* of the reinforcing sheets 6 of the FFCs 1, 100 may be eliminated, and the positioning projections 30, 31 of the holder 22 may also be eliminated.

The present invention may be applied to an electric connector of the side type in which the FFCs 1, 100 are inserted transversely along the surface of a printed board, instead of the type in which the FFCs 1, 100 are inserted from above the printed board.

Embodiments of the present invention have been discussed in detail, but these embodiments are mere specific examples for clarifying the technical contents of the present invention. Therefore, the present invention should not be construed as limited to these specific examples. The spirit and scope of the present invention are limited only by the appended claims.

This Application corresponds to Japanese Patent Application No. 2003-164057 filed with the Japanese Patent Office on Jun. 9, 2003, the full disclosure of which is incorporated herein by reference.

We claim:

1. A plug-type connector for connecting end portions of a pair of FFCs extending in parallel to each other, comprising:

a holder including a placing frame provided on a surface and backside thereof with a pair of placing faces on which end portions of the pair of FFCs are respectively placed, the placing frame having a first placing plate and a second placing plate being disposed apart from and extending parallel to one another, the first and second placing plates being connected to each other at facially opposing sides by connecting portions, the first placing plate defining one of the pair of placing faces and the second placing plate defining a remaining one of the pair of placing faces; and a fixing member operative for fixing the end portions of the pair of FFCs to the corresponding placing faces of the holder, the fixing member including:

an annular portion which defines an insertion hole into which the placing frame of the holder with the end portions of the FFCs placed on the corresponding placing faces, is inserted together with the FFCs;

engagement portions which are engageable with corresponding engaged portions of the holder when the annular portion is brought toward the holder with the pair of FFCs previously inserted into the insertion hole of the annular portion; and a first frame, a second frame and an intermediate frame extending parallel with one another, the intermediate frame disposed in the insertion hole and disposed apart from and between the first and second frames, wherein, when the placing frame of the holder is inserted into the insertion hole and engaged with the fixing member, the first and second placing plates are disposed between the first and second frames and the intermediate frame is received between the first and second placing plates.

2. A plug-type connector according to claim 1, wherein the fixing member includes: a pair of lateral frames for connecting corresponding ends of the first and second frames to each other, the lateral frames and the first and second frames defining the annular portion.

3. A plug-type connector according to claim 2, wherein the first and second placing plates are different from each other in width, and the first and second frames are different from each other in width.

4. A plug-type connector for connecting end portions of a pair of FFCs extending in parallel to each other, comprising:

a holder including a placing frame provided on a surface and backside thereof with a pair of placing faces on which end portions of the pair of FFCs are respectively placed; and a fixing member capable of fixing the end portions of the pair of FFCs to the corresponding placing faces of the holder, the fixing member including:

an annular portion which defines an insertion hole into which the placing frame of the holder with the end portions of the FFCs placed on the corresponding placing faces, is inserted together with the FFCs; and engagement portions which are engageable with corresponding engaged portions of the holder when the annular portion is brought toward the holder with the pair of FFCs previously inserted into the insertion hole of the annular portion, wherein the placing frame of the holder includes: first and second placing plates respectively provided on mutually reverse sides thereof with the corresponding placing faces; and connecting portions for connecting the first and second placing plates to each other, the fixing member includes: first and second frames for holding the ends of the corresponding FFCs between the first and second frames and the corresponding placing faces; and a pair of lateral frames for connecting corresponding ends of the first and second frames to each other, the lateral frames and the first and second frames defining the annular portion, wherein a concave is formed between rear end portions of the first and second placing plates of the holder, and the fixing member further includes an intermediate frame which connects the pair of lateral frames to each other, which extends in parallel to the first and second frames, and which is engageable with the concave.

5. A plug-type connector according to claim 2, wherein the holder includes, on each of the placing faces, a pair of holding frames for defining grooves into which a pair of lateral edges of each of the end portions of the corresponding FFCs, can be introduced, the fixing member includes a pair of projection portions which project from each of the first and second frames to come in contact with the corresponding holding frames of the holder, the engagement portions are respectively formed on the projection portions, and the holding frames and the corresponding projection portions are combined with each other, thus forming a part of an insertion projecting portion to be inserted into an insertion concave of a mating connector.

6. A plug-type connector for connecting end portions of a pair of FFCs extending in parallel to each other, comprising:

a holder including a placing frame provided on a surface and backside thereof with a pair of placing faces on which end portions of the pair of FFCs are respectively placed; and a fixing member capable of fixing the end portions of the pair of FFCs to the corresponding placing faces of the holder, the fixing member including:

an annular portion which defines an insertion hole into which the placing frame of the holder with the end portions of the FFCs placed on the corresponding placing faces, can be inserted together with the FFCs; and engagement portions which are engageable with corresponding engaged portions of the holder when the annular portion is brought toward the holder with the pair of FFCs previously inserted into the insertion hole of the annular portion, wherein a reinforcing sheet is attached to backside of the end portion of each FFC for holding exposed conductors in a row, and a pulling-out preventing projection is formed on each of the placing faces of the holder, the pulling-out preventing projection being engageable with an edge portion of the reinforcing sheet of each FFC.

7. An electric connector provided with a plug-type connector for connecting end portions of a pair of FFCs extending in parallel to each other, and a receptacle-type connector combined with the plug-type connector, the plug-type connector having an insertion projecting portion to be inserted into an insertion concave of the receptacle-type connector, and the receptacle-type connector including: a housing defining the insertion concave into which the insertion projecting portion of the plug-type connector is inserted; and a plurality of contacts arranged side by side in the insertion concave, wherein the plug-type connecter includes:

a unitary holder including a placing frame provided on a surface and backside thereof with a pair of placing faces on which end portions of the pair of FFCs are respectively placed; and a unitary fixing member capable of fixing the end portions of the pair of FFCs to the corresponding placing faces of the holder, the fixing member including:

an annular portion which defines an insertion hole into which the placing frame of the holder with the end portions of the FFCs placed on the corresponding placing faces, can be inserted together with the FFCs; and engagement portions which are engageable with corresponding engaged portions of the holder when the annular portion is brought toward the holder with the pair of FFCs previously inserted into the insertion hole of the annular portion.

8. An electric connector according to claim 7, wherein the placing frame of the holder includes: first and second placing plates respectively provided on mutually reverse sides thereof with the corresponding placing faces; and connecting portions for connecting the first and second placing plates to each other, the fixing member includes: first and second frames for holding the ends of the corresponding FFCs between the first and second frames and the corresponding placing faces; and a pair of lateral frames for connecting corresponding ends of the first and second frames to each other, the lateral frames and the first and second frames defining the annular portion.

* * * * *